US008062142B2

(12) United States Patent
Underbrink et al.

(10) Patent No.: US 8,062,142 B2
(45) Date of Patent: Nov. 22, 2011

(54) COLLABORATIVE PLAY TOY

(75) Inventors: John M. Underbrink, Richardson, TX (US); Charlene Underbrink, legal representative, Richardson, TX (US); Brian D. Lovgren, Shelton, WA (US); Paul J. Danforth, Olympia, WA (US)

(73) Assignee: Playcore Wisconsin, Inc., Chattanooga, TN (US)

( * ) Notice: Subject to any disclaimer, the term of this patent is extended or adjusted under 35 U.S.C. 154(b) by 99 days.

(21) Appl. No.: 12/412,265

(22) Filed: Mar. 26, 2009

(65) Prior Publication Data

US 2010/0234118 A1 Sep. 16, 2010

Related U.S. Application Data

(60) Provisional application No. 61/159,379, filed on Mar. 11, 2009.

(51) Int. Cl.
*A63G 11/00* (2006.01)
*A63G 13/00* (2006.01)

(52) U.S. Cl. ..... 472/113; 472/39; 472/135

(58) Field of Classification Search ..... 472/29–38, 472/106–115, 135
See application file for complete search history.

(56) References Cited

U.S. PATENT DOCUMENTS

| | | | | | |
|---|---|---|---|---|---|
| 2,113,131 | A | * | 4/1938 | Eyerly | 472/39 |
| 2,819,080 | A | * | 1/1958 | Pittaluga | 472/5 |
| 3,339,919 | A | * | 9/1967 | Jones | 472/19 |
| 3,675,919 | A | * | 7/1972 | Ewers | 472/113 |
| 3,836,140 | A | * | 9/1974 | Ahrens | 472/113 |
| 4,226,411 | A | * | 10/1980 | Manus | 472/110 |
| 4,341,377 | A | * | 7/1982 | Ahrens | 472/113 |
| 4,896,877 | A | * | 1/1990 | Moomaw et al. | 472/5 |
| 6,022,276 | A | | 2/2000 | Knijpstra | |
| 6,929,551 | B1 | | 8/2005 | Ballmick | |

FOREIGN PATENT DOCUMENTS

| | | | |
|---|---|---|---|
| JP | 11-137853 | A | 5/1999 |
| KR | 20-0240587 | Y1 | 10/2001 |
| KR | 20-0344102 | Y1 | 3/2004 |

OTHER PUBLICATIONS

International Search Report mailed Mar. 12, 2010, issued in corresponding International Application No. PCT/US2009/038453, filed Mar. 26, 2009.

Written Opinion of the International Search Authority mailed Mar. 12, 2010, issued in corresponding International Application No. PCT/US2009/038453, filed Mar. 26, 2009.

"Playmotion Triple Rock," Xccent Inc., Osceola, Wisconsin, 2-page brochure, at least as early as Aug. 2008.

"Big Toys Epicenter," © 2008 Big Toys, Inc., Olympia, Washington, 1-page brochure.

* cited by examiner

*Primary Examiner* — Kien Nguyen
(74) *Attorney, Agent, or Firm* — Christensen O'Connor Johnson Kindness PLLC

(57) ABSTRACT

A collaborative play toy generally includes a plurality of satellite assemblies capable of a first movement and a second movement, and a center assembly coupled to the plurality of satellite assemblies. The center assembly is configured to move in response to the first movement of a first satellite assembly and to create a second movement in a second satellite assembly.

18 Claims, 15 Drawing Sheets

COLLABORATIVE PLAY TOY

CROSS-REFERENCE TO RELATED APPLICATION

This application claims the benefit of U.S. Provisional Application No. 61/159,379, filed on Mar. 11, 2009, the disclosure of which is hereby expressly incorporated by reference.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, a collaborative play toy is provided. The collaborative play toy generally includes a plurality of satellite assemblies capable of a first movement and a second movement. The play toy further includes a center assembly coupled to the plurality of satellite assemblies, wherein the center assembly is configured to move in response to the first movement of a first satellite assembly and to create a second movement in a second satellite assembly.

In accordance with another embodiment of the present disclosure, a collaborative play toy is provided. The collaborative play toy generally includes a plurality of satellite assemblies capable of movement. The play toy further includes a center assembly coupled to the plurality of satellite assemblies for linking movement, wherein first satellite assembly is capable of rocking movement, causing the center assembly moves in response to the rocking movement to create a substantially linear movement in the second satellite assembly.

In accordance with another embodiment of the present disclosure, a collaborative play toy is provided. The collaborative play toy generally includes a plurality of satellite assemblies capable of a first movement and a second movement. The play toy further includes a center assembly movably coupled to the plurality of satellite assemblies, wherein the center assembly includes a biasing system configured to move in response to the first movement of a first satellite assembly and to create a second movement in a second satellite assembly.

DESCRIPTION OF THE DRAWINGS

The foregoing aspects and many of the attendant advantages of this disclosure will become more readily appreciated by reference to the following detailed description, when taken in conjunction with the accompanying drawings, wherein.

DETAILED DESCRIPTION

Figure 1:
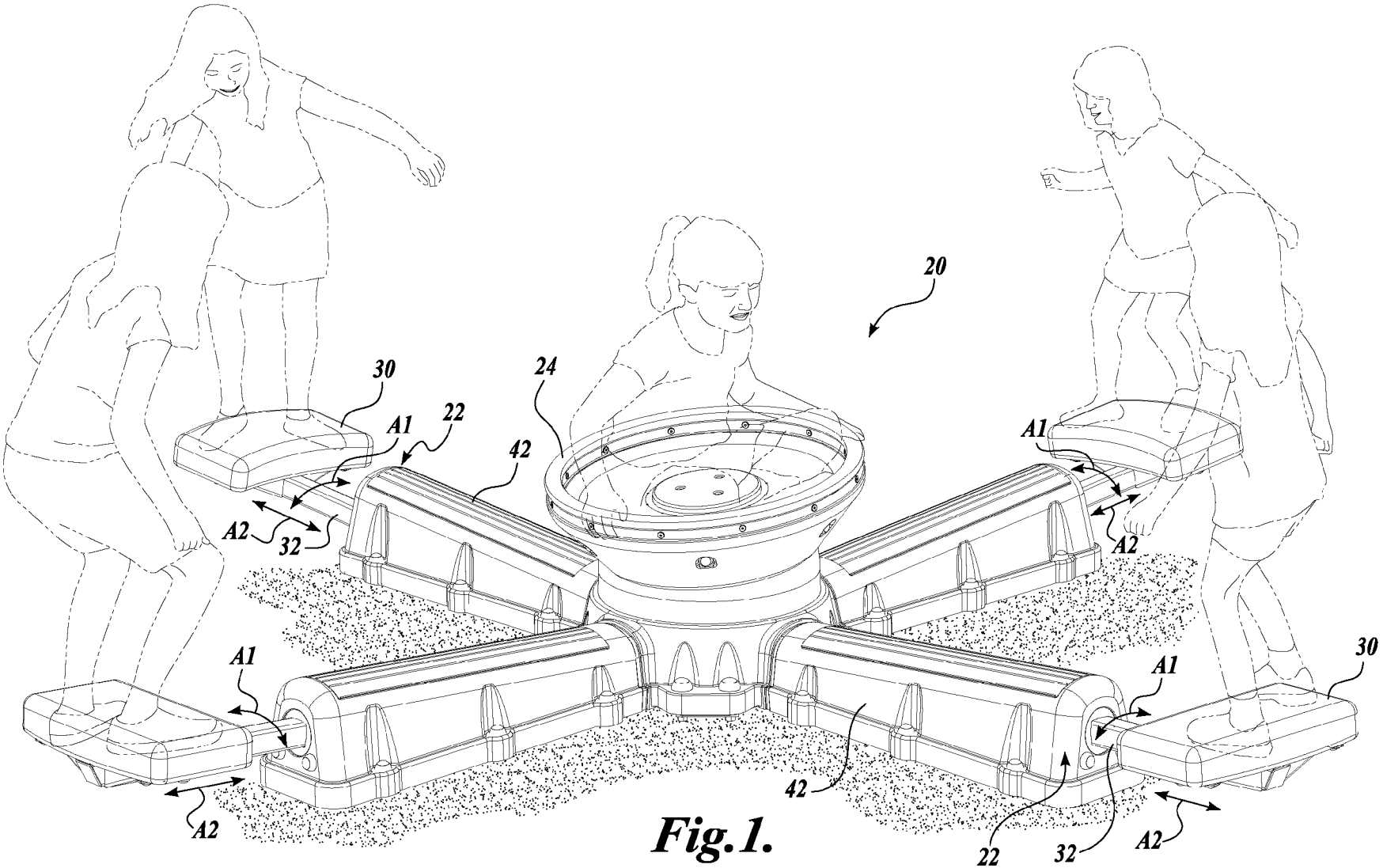
FIG. 1 is a perspective view of a collaborative play toy in accordance with embodiments of the present disclosure.

Embodiments of the present disclosure are directed to a collaborative play toy for users, for example, children users on a playground. Referring to FIG. 1, a collaborative play toy 20 includes a plurality of satellite assemblies 22 capable of moving in a plurality of directions, and a center assembly 24 coupled to the plurality of satellite assemblies 22. Although there are four satellite assemblies 22 shown in the illustrated embodiment, it should be appreciated that a play toy 20 in accordance with embodiments of the present disclosure may include any number of satellite assemblies. As best seen in FIG. 1, users may participate in collaborate play by riding on the individual satellite assemblies 22 or on the center assembly 24.

The movement of an individual satellite assembly 22 may result from forces made on the individual satellite assembly 22 by at least two sources: (1) directly by forces put on the individual satellite assembly 22 by a user (e.g., rocking movement, see arrows labeled A1); and (2) indirectly by linking to other satellite assemblies 22 (also having forces put on them directly by other users) through the center assembly 24 (e.g., forward and backward substantially linear movement, see arrows labeled A2). Moreover, the movement of the center assembly 24 may result from forces made on the individual satellite assemblies 22. In addition, the movement of the center assembly 24 may also cause movement in one or more of the satellite assemblies 22. These forces and the movement of the satellite assemblies 22 and the center assembly 24 in response to these forces will be described in greater detail below.

Figure 2:
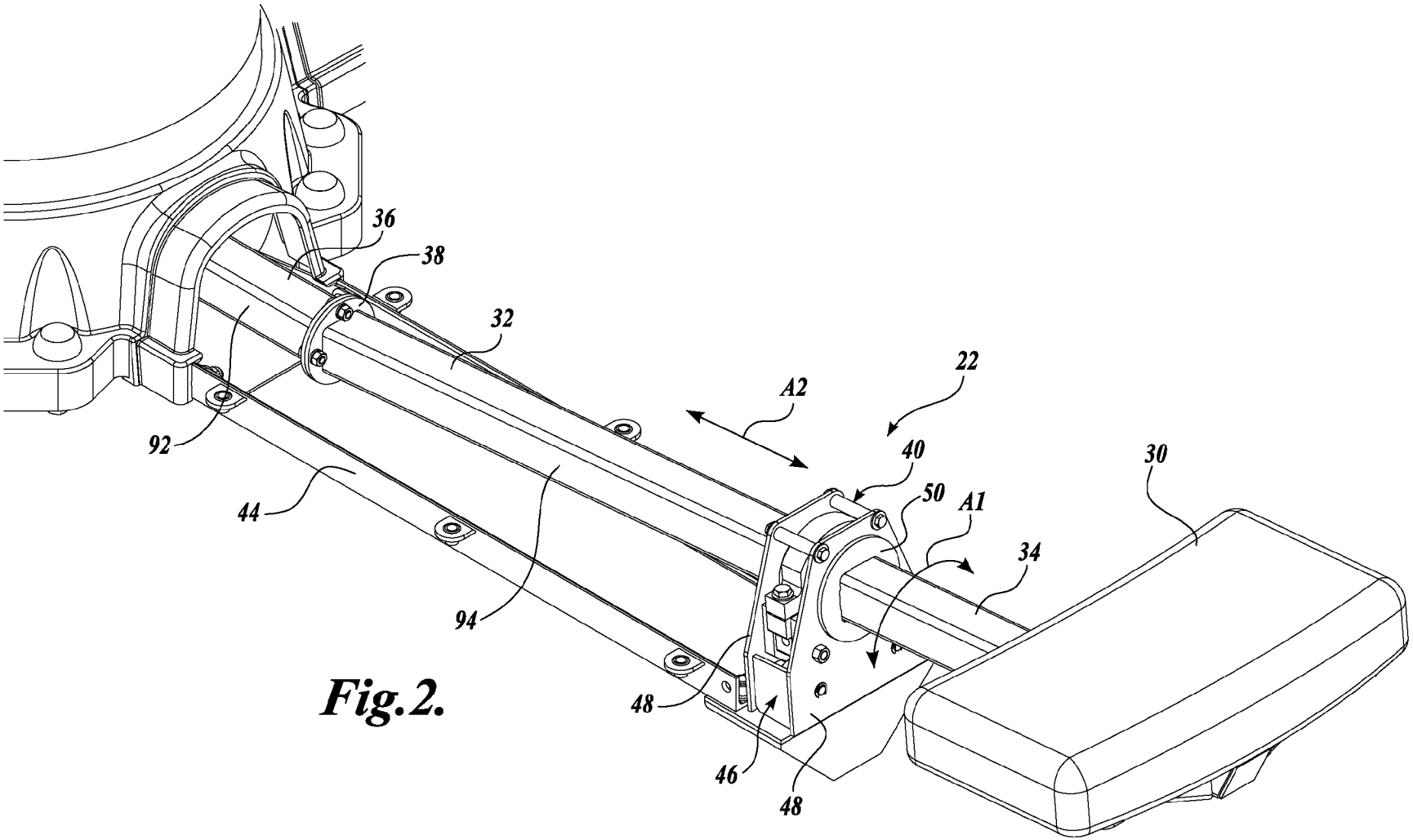
FIG. 2 is a perspective view of a satellite assembly of the play toy of FIG. 1.
Figure 3:
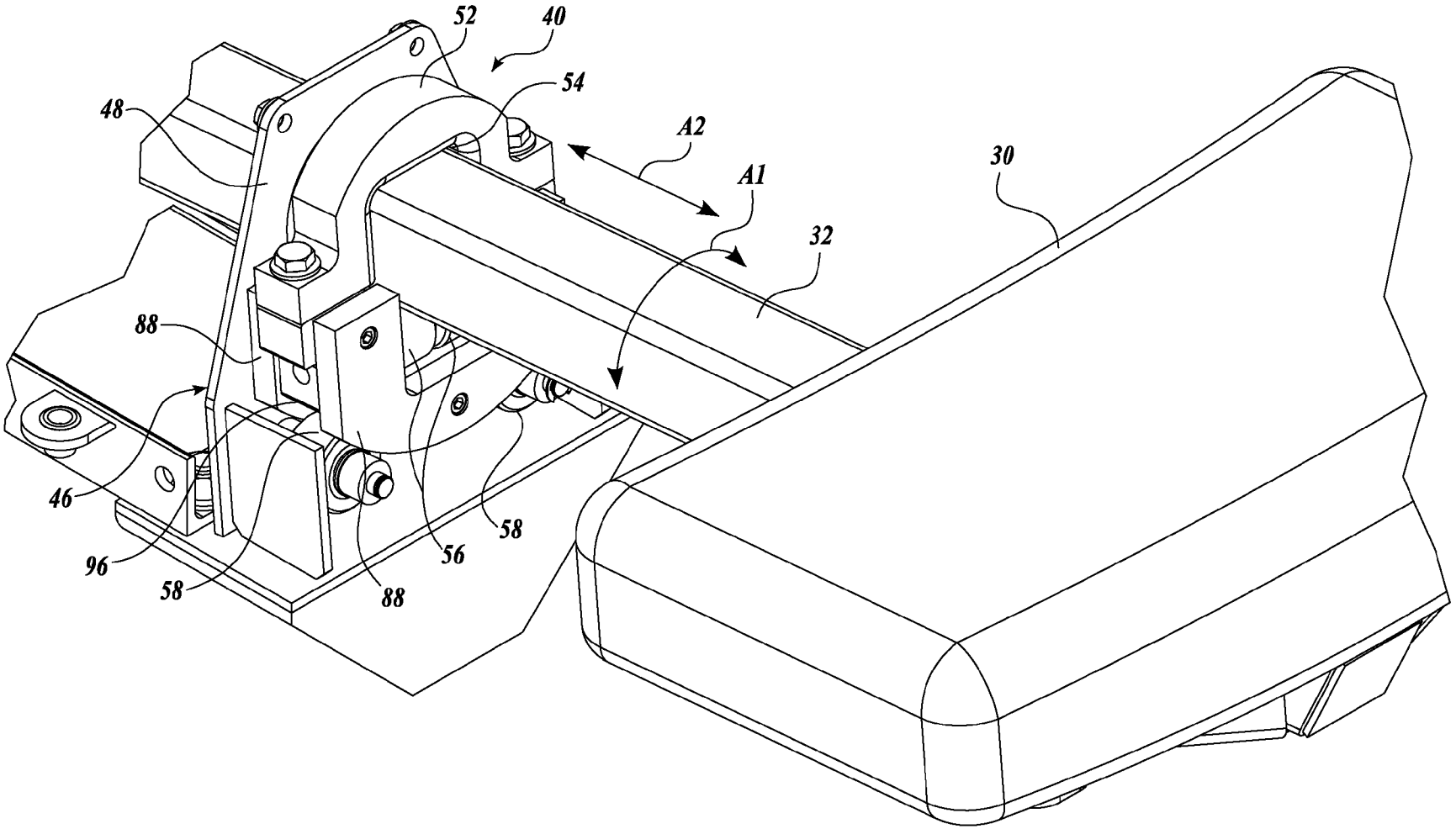
FIG. 3 is a close-up perspective view of a bearing assembly of the satellite assembly of FIG. 2.

Referring to FIGS. 2 and 3, the satellite assemblies will first be described in greater detail. Each satellite assembly 22 includes a satellite platform 30 for a user to stand, sit, or otherwise put their weight on the satellite assembly 22. The users may move their individual satellite platforms 30 by rocking side-to-side on the platforms 30. Such rocking movement is indicated by arrows labeled A1 in FIGS. 1-3. A rocking movement on one satellite assembly 22 results in substantially the same rocking movement in an opposite satellite assembly 22, and it results in forward and backward substantially linear movement in adjacent satellite assemblies 22. Such substantially linear movement is indicated by arrows labeled A2 in FIGS. 1-3. Rocking movement and the resultant substantially linear movement will be described in greater detail below, but can be best seen in FIGS. 7-14.

FIG. 2 is a close-up view of a satellite assembly 22 with the protective cover 42 for the arm 32 (see FIG. 1) removed from the protective cover base 44 for ease of viewing the components of the satellite assembly 22. Each satellite assembly 22 further includes a satellite arm 32 having first and second ends 34 and 36. Each user platform 30 is rigidly fixed to the first end 34 of the arm 32. The second end 36 of the arm 32 is movably coupled to the center assembly 24, as described in greater detail below. In the illustrated embodiment, the arms 32 generally have a substantially square cross-sectional shape with rounded corners; however, it should be appreciated that other cross-sectional shapes are also within the scope of the disclosure, including but not limited to substantially circular, oval, rectangular, triangular, hexagonal, and other polygonal shapes. The cross-sectional shape of each arm 32 is defined to mate with a receiving shape of a satellite bearing assembly 40 (see FIG. 2).

As described in greater detail below, the satellite bearing assemblies 40 support and facilitate the movement of the arms 32. In that regard, the bearing assembly 40 is configured to allow for movement of the arm 32 in a plurality of directions (for example, in the directions indicated by arrows A1 and A2 in FIGS. 1-3). Specifically, the bearing assembly 40 provides support and a lubricated surface for a moving satellite assembly 22 (e.g., to the satellite platform 30 and the arm 32) to allow the satellite assembly 22 to move more easily.

It should be appreciated that the arms 32 may also include joints 38 to allow for slight bends in the arms 32 to provide clearance as the satellite assemblies 22 move in different directions (see FIG. 2). As best seen in FIG. 2 and also seen in FIG. 11, there is about a 5-degree incline between the first arm portion 92 and the second arm portion 94, which are joined together at joint 38. It should be appreciated, however, that the incline may be at any suitable degree. This incline aids in allowing the satellite platforms 30 to have some distance from the ground surface to rock side-to-side without hitting the ground surface. Moreover, the incline positions the satellite platform 30 in a slight forward leaning position, which helps the user in lowering his or her center of gravity for improved balance on the satellite platform 30. In the illustrated embodiment, the satellite bearing assembly 40 is also configured to agree with the incline of the second arm portion 94.

Figure 6:
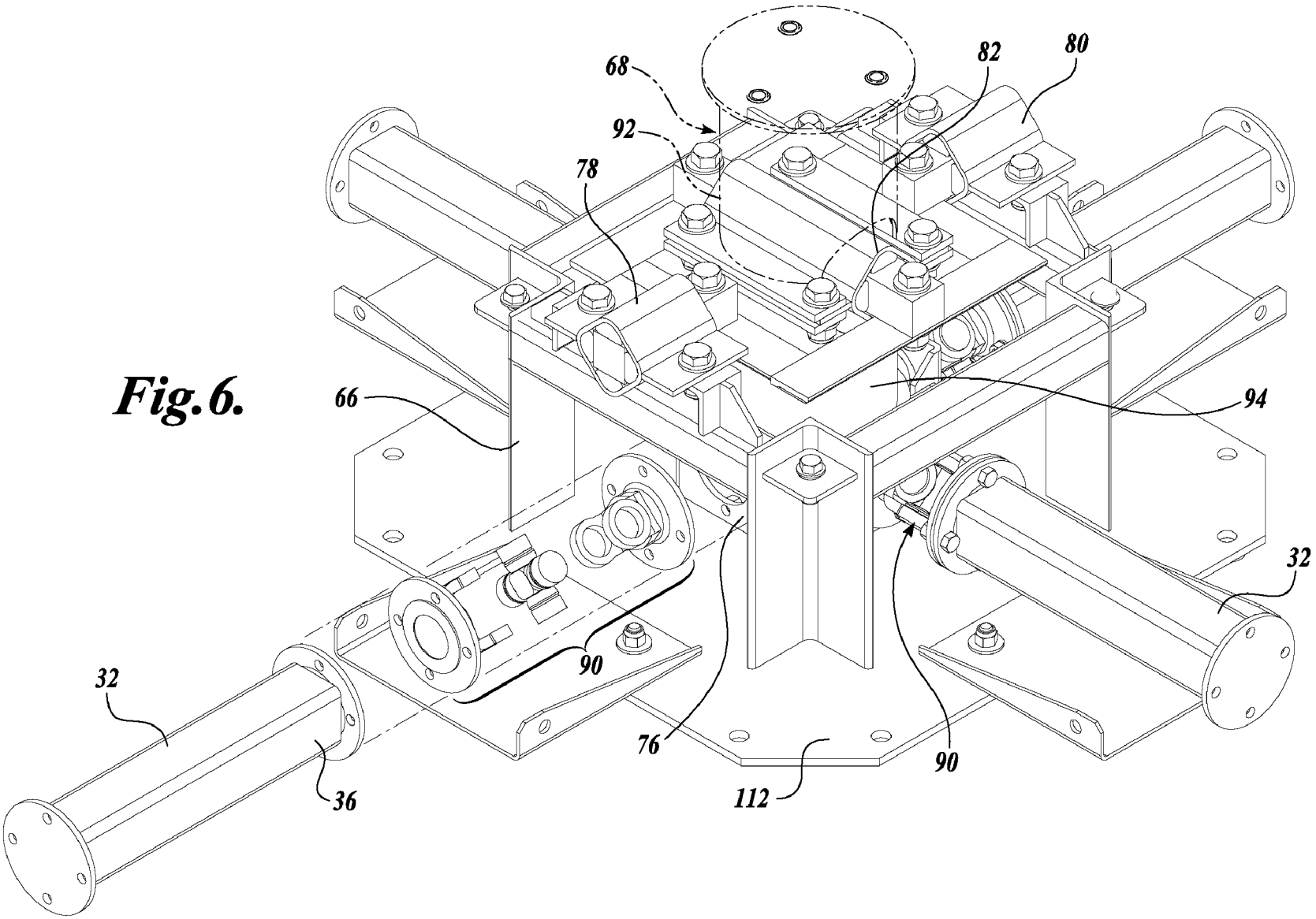
FIG. 6 is a close-up, partially exploded, perspective view of the column assembly of the FIG. 5 including portions of arms attached to the column assembly.

It should be appreciated that the arms 32 are coupled to the center assembly 24 (see FIG. 6). As described in greater detail below, the coupling between the satellite assemblies 22 and the center assembly 24 may be a moveable coupling. As mentioned above, the satellite assemblies 22 move as a result of forces on the satellite assemblies 22 (for example, by direct and indirect movement of users). Additionally, the center assembly 24 moves as a result of forces on the center assembly 24 (for example, as a result of movement of the coupled satellite assemblies 22).

As mentioned above, each satellite assembly 22 has a bearing assembly 40 that is configured to allow movement of the arm 32 in a plurality of directions (for example, in the directions indicated by arrows A1 and A2 in FIGS. 1-3). The bearing assembly 40 includes a bearing assembly frame 46 for protection and support of the bearing components, the bearing assembly frame 46 including outer sidewalls 48. A guard 50 on the sidewall 48 nearest the platform 30 prevents users from putting their fingers into the bearing assembly frame 46, which may result in injury.

FIG. 3 is a close-up view of a bearing assembly 40 with one sidewall 48 removed for ease of viewing the internal components of the bearing assembly 40. In the illustrated embodiment, the bearing assembly 40 includes a bearing collar 52 having an arm receiving bore 54, and a bearing assembly frame 46 for protection of the bearing components (as mentioned above). As seen in the illustrated embodiment, the bearing collar 52 includes first and second portions defining the arm receiving bore 54 (e.g., top and bottom portions). However, it should be appreciated that the bearing collar 52 may be manufactured as one piece.

The bearing collar 52 further includes thrust bearings 88 located on either side of the bottom portion of the bearing collar 52, sandwiched between the bottom portion of the bearing collar and the sidewalls 48 of the frame 46. The thrust bearings may be manufactured from a resilient bearing material, for example, a ultra high molecular weight polyethylene or another rubber or polymer material, to minimize friction between the bearing collar 52 and the bearing assembly frame 46. It should further be appreciated that at least some portions of the arm receiving bore 54 of the bearing collar 52 may also include resilient bearing material to minimize the friction between the bearing collar 52 and the arm 32 as it slides through the arm receiving bore 54 of the bearing collar 52.

The bearing assembly 40 further includes at least one first bearing 56 for substantially linear movement (or backward and forward translational movement) of the arm 32 through the bearing collar 52, and at least one second bearing 58 for rotational (or rocking) movement of the bearing collar 52 in the bearing assembly frame 46. In the illustrated embodiment, the bearing assembly 40 includes two first bearings 56 and two second bearings 58, both of the first and second bearings being roller bearings. However, it should be appreciated that other suitable types of bearings are also within the scope of the present disclosure, for example, including but not limited to ball bearings, needle bearings, spherical roller bearings, axles, and thrust bearings.

The bearing assembly 40 is configured to allow rotational or rocking movement substantially in a z-plane substantially around an x- or y-axis, and substantially linear movement (or backward and forward translational movement) substantially on an x- or y-axis. The movement in the x-, y-, and z-axes can be best seen in FIGS. 7-14. In that regard, the bearing collar 52 is a floating component supported by the second bearings 58. The bearing collar 52 surrounds and receives the arm 32 in the arm receiving bore 54, but is not rigidly fixed to the arm 32 or any other part of the assembly 22. However, the bearing collar 52 is surrounded by the bearing assembly frame 46 to prevent movement of the bearing collar 52 along the arm 32 in the x- or y-direction.

The bearing collar 52 is further supported by the second bearings 58. In the illustrated embodiment of FIG. 3, the second bearings 58 enable rotational or rocking movement of the bearing collar 52 in the substantially z-plane substantially around the x- or y-axis. The second bearings 58 nest in a rounded channel 96 on the underside of the bearing collar 52 (defined by the thrust bearings 88 located on either side of the bottom portion of the bearing collar 52) to allow for rotational or rocking movement of the bearing collar 52 as the arm 32 rocks side-to-side with the satellite platform 30 (see the movement of arrow A1 in FIG. 3). Therefore, as the arm 32 rotates or rocks side-to-side, the bearing collar 52 rocks with the arm 32. Moreover, the first bearings 56 support the arm 32 and allow the arm 32 to move in a substantially linear path (or a backward and forward translational path), through the arm receiving bore 54 of the bearing collar 52 substantially on an x- or y-axis (see the movement of arrow A2 in FIG. 3).

The resulting combinations of rotational and substantially linear movement allow for multi-directional movement of the satellite assemblies 22 in the x-, y-, and/or z-dimensions. As will be described in greater detail below, the coupling between the satellite assemblies 22 and the center assembly 24 causes each individual satellite assembly 22 to impart movement to the center assembly 24 and the other satellite assemblies 22. For example, an individual satellite assembly 22 will impart substantially linear movement (or backward and forward translational movement) substantially on an x- or y-axis to adjacently positioned assemblies 22 and rotational or rocking movement substantially in a z-plane substantially around an x- or y-axis for oppositely positioned assemblies 22.

Figure 4:
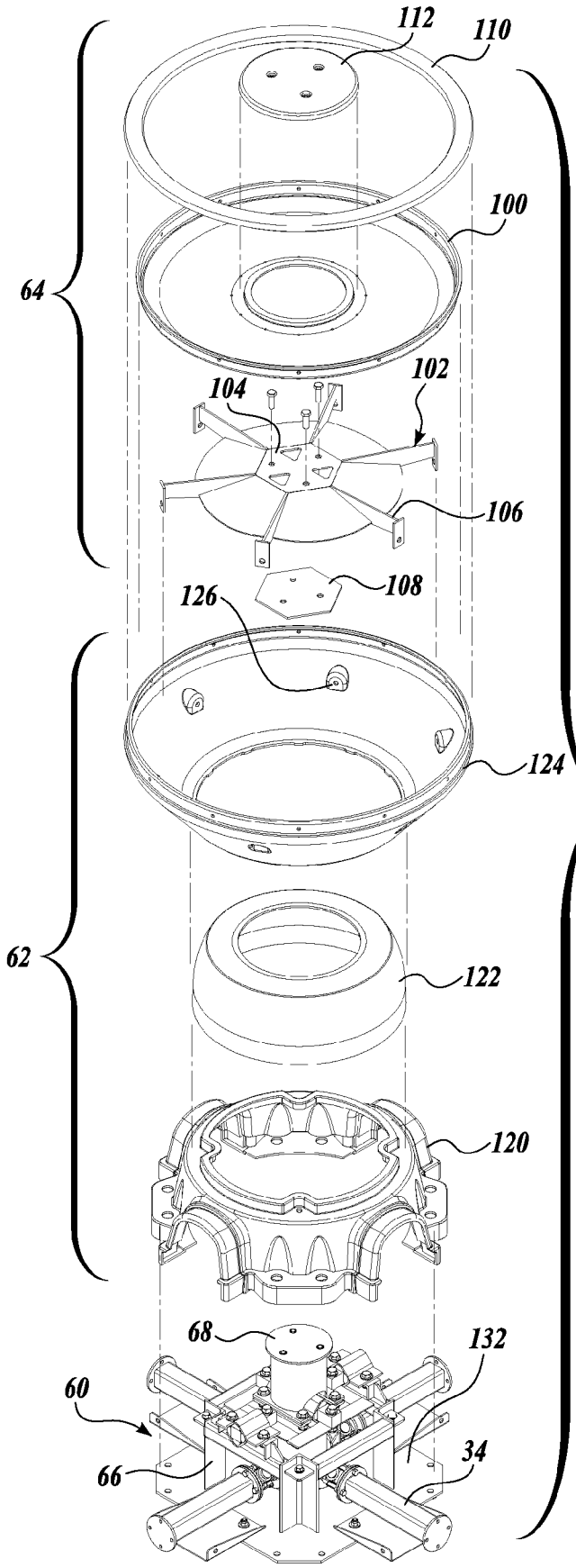
FIG. 4 is an exploded view of the center assembly of the play toy of FIG. 1.

Referring to FIG. 4, the individual components of the center assembly 24 will now be described in greater detail. The center assembly 24 includes a center mechanical assembly 60, a center cover assembly 62 to provide protection for the center mechanical assembly 60, and a center platform assembly 64. The center mechanical assembly 60 includes a fixed frame 66 and a column assembly 68 that moves relative to the fixed frame 66 (see FIGS. 7-14). The fixed frame 66 is designed to be a stationary component of the center assembly 24, and may include a base 132 for attachment to the ground, as described below with reference to FIG. 15.

Before discussing the center mechanical assembly 60 in detail, the forces acting on the column assembly 68 will briefly be described. In that regard, because the satellite assemblies 22 and column assembly 68 are coupled to one another, the forces acting on the column assembly 68 are a result of forces acting on the plurality of satellite assemblies 22. Specifically, the satellite assemblies 22 and the column assembly 68 are coupled by a movable coupling. In the illustrated embodiment, as best seen in FIG. 6 the movable coupling between the satellite assemblies 22 (via arms 32) and the column assembly 68 is a universal joint 90. One end of the universal joint 90 connects to the second end 36 of an arm 32, and the other end of the universal joint 90 connects to the arm connection portion 76 of the column assembly 68. The universal joint 90 thus allows for movement of both the satellite assemblies 22 (via arms 32) and the column assembly 68 in a plurality of directions. It should be appreciated that other movable couplings are also within the scope of the present disclosure, including but not limited to flexible joints, living hinges, and swivel blocks.

The column assembly 68 is normally biased to the center position shown in FIG. 6, for example, when at rest with no forces acting on the column assembly 68. As discussed above, individual users may move their individual satellite assemblies 22 by rocking side-to-side on the platforms 30. Such rocking or rotational movement is indicated by arrows labeled A1 in FIGS. 1-3. As a result of the coupling between the column assembly 68 and the satellite assemblies 22, the rocking movement results in substantially the same rocking movement in an opposite satellite assembly and forward backward translational movement in adjacent satellite assemblies 22 (indicated by arrows labeled A2 in FIGS. 1-3).

In a simplified scenario of collaborative play, as seen in FIGS. 7-10 in top plan view (with the resting position of the play toy 20 shown in phantom) and FIGS. 11-14 in perspective view, when one user rocks side-to-side on a platform 30*a* of a first satellite assembly 22*a*, the arm 32*a* also rocks side-to-side. Because of the coupling between the arm 32*a* and the column assembly 68, the rocking of the satellite assembly 22*a* forces the column assembly 68 to rock in substantially the same side-to-side movement. As the column assembly 68 rocks side-to-side, the column assembly 68 forces the opposite satellite assembly 22*b* to rock side-to-side (as indicated by arrows A1) and the adjacent satellite assemblies 22*c* and 22*d* to move in a forward and backward translational movement (as indicated by arrows A2).

Figure 7:
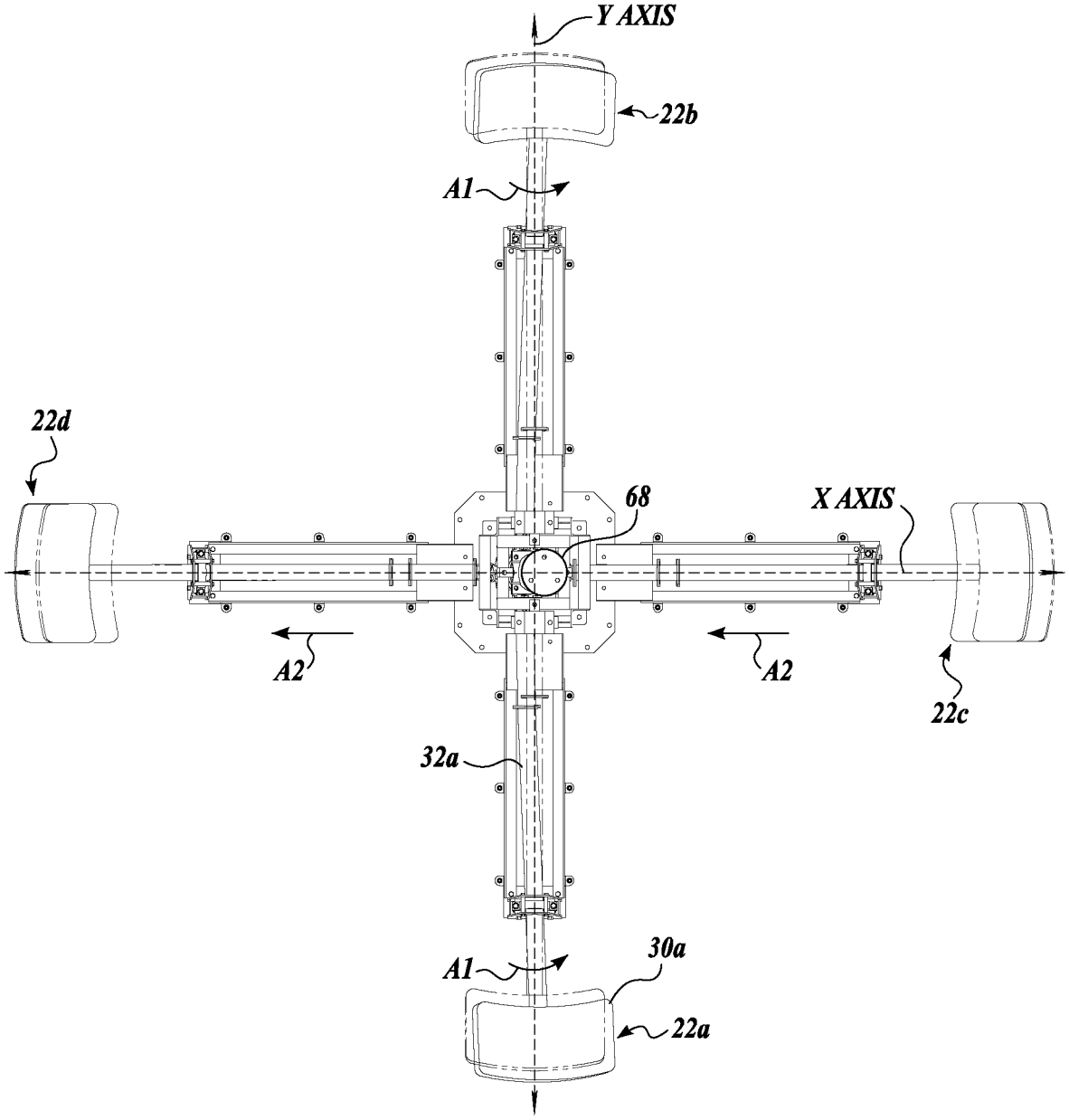
FIGS. 7-10 are top plan views of the play toy of FIG. 1 in a plurality of different positions.
Figure 8:
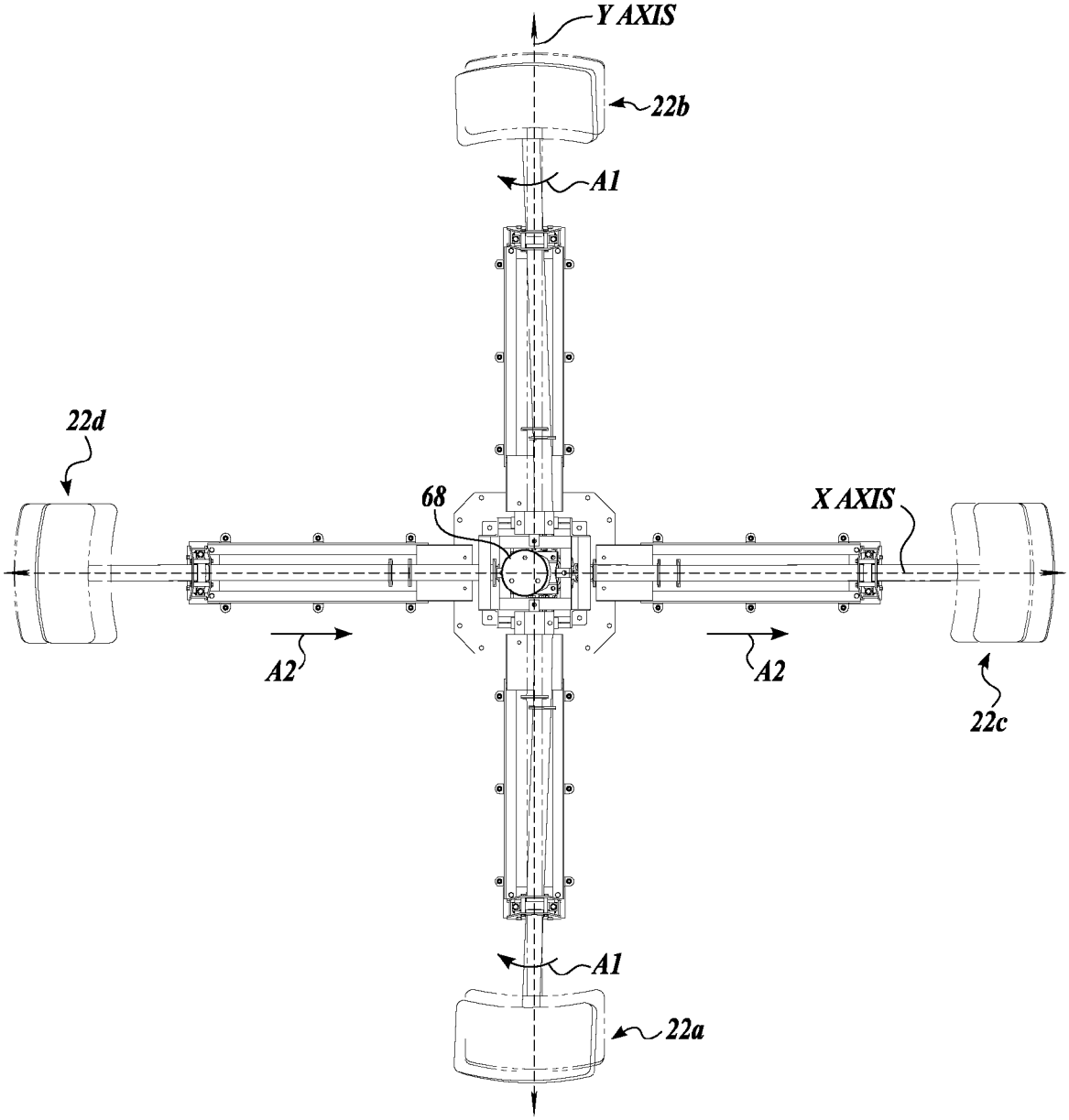
Figure 9:
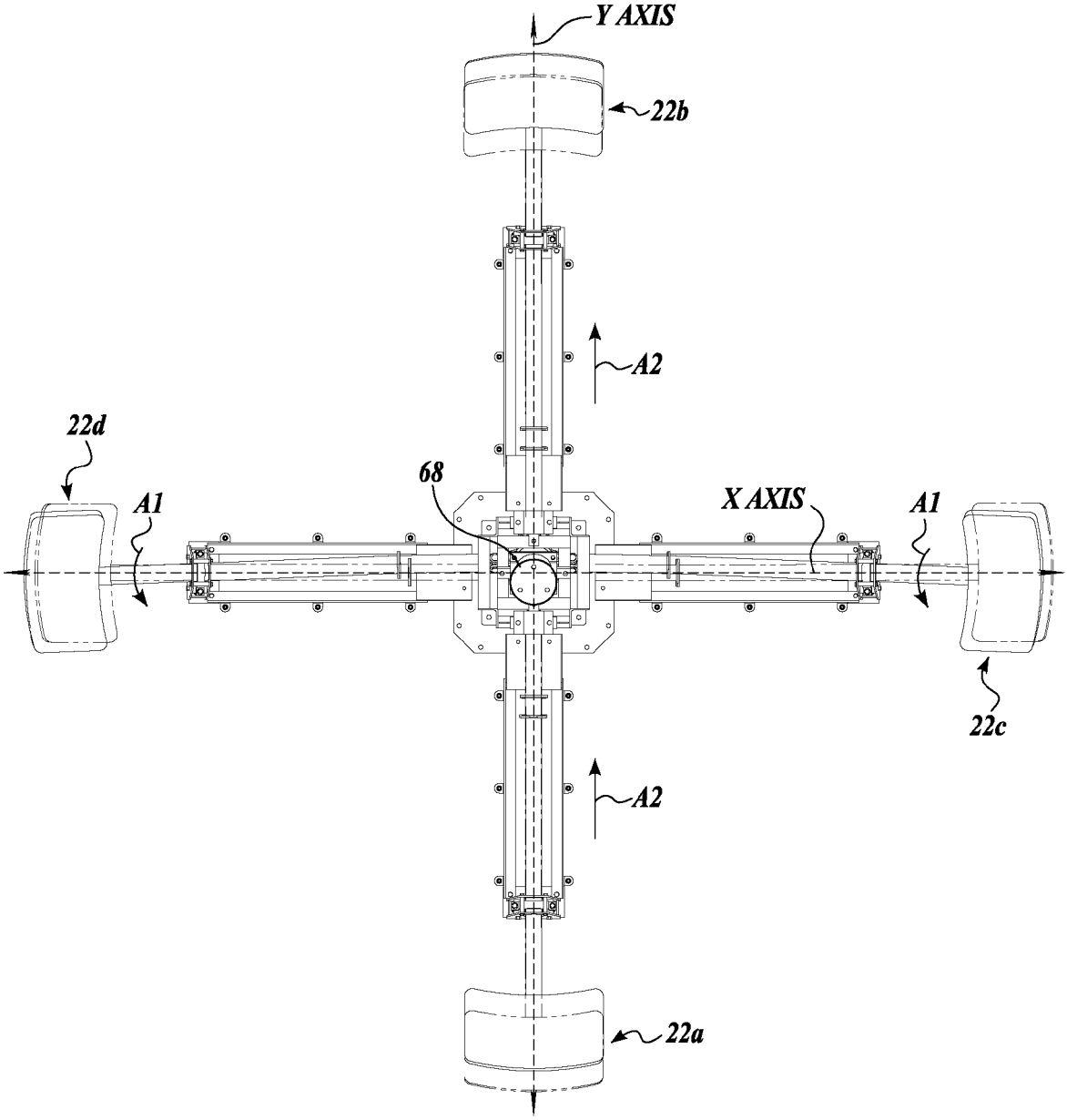
Figure 10:
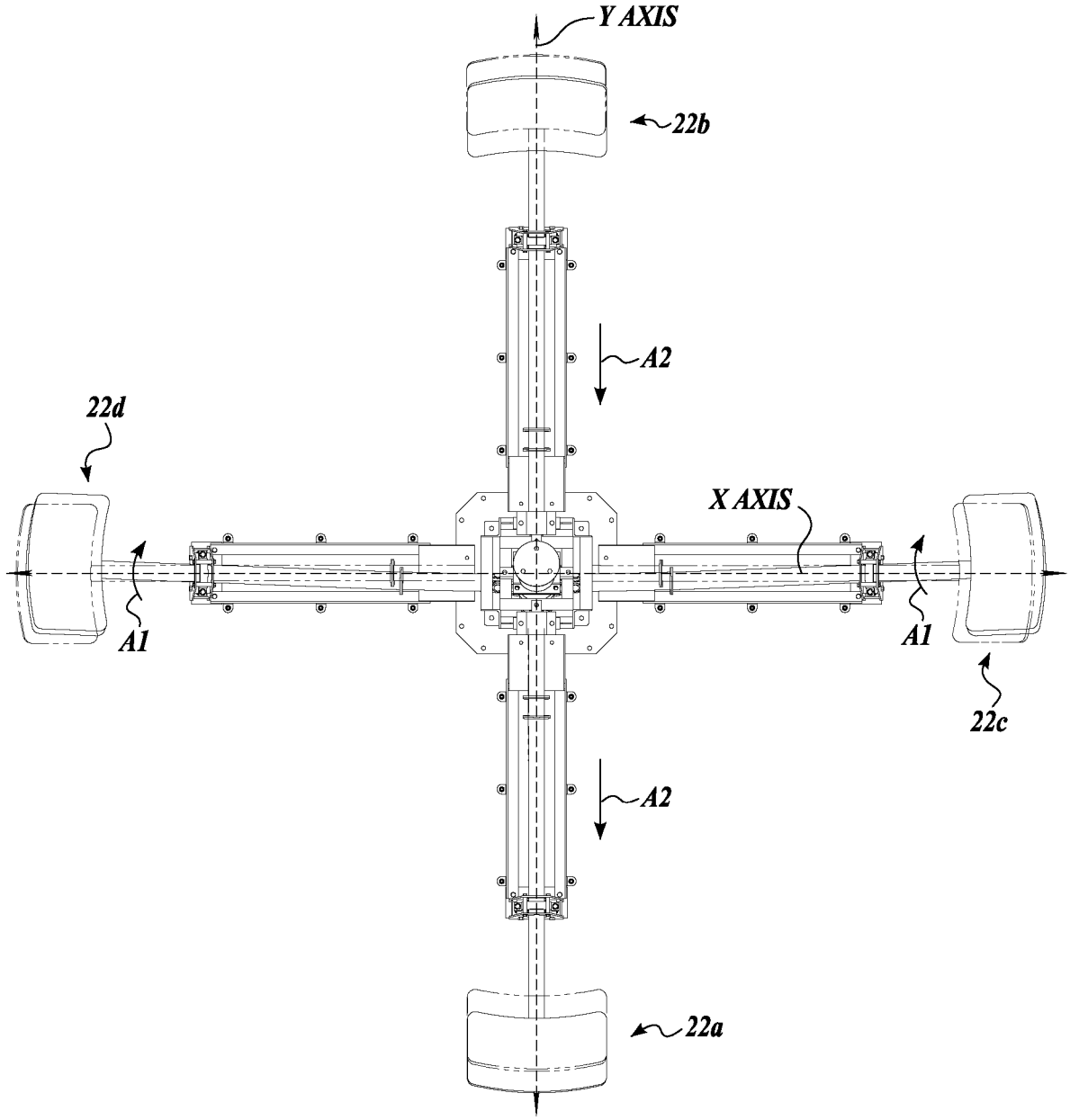

In the illustrated embodiment of FIG. 7 (see also corresponding FIG. 11), the first satellite assembly 22*a* is rocked to the right side (rotating about the y-axis, as indicated by arrow A1), as is the opposite satellite assembly 22*b*. The adjacent satellite assemblies 22*c* and 22*d* have moved, respectively, backward and forward (substantially linearly along an x-axis, as indicated by arrows A2). FIG. 8 shows a rocking movement to the left (see also corresponding FIG. 12). FIGS. 9 and 10 (and corresponding FIGS. 13 and 14) show rocking movement by satellite assemblies 22*c* and 22*d* (rotating substantially about an x-axis, as indicated by arrows A1) and backward and forward translational movement by satellite assemblies 22*a* and 22*b* (substantially linearly along the y-axis, as indicated by arrows A2).

Because multiple users may be rocking from side-to-side on individual satellite platforms 30 at any given time, the center assembly 24 is configured to allow for random movement in multiple directions. In an ideal scenario of collaborative play, each user is rocking from side-to-side on his or her individual satellite platform 30, resulting in a substantially circular movement for the center assembly 24 and also a substantially circular movement for each of the individual satellite platforms 30.

Figure 5:
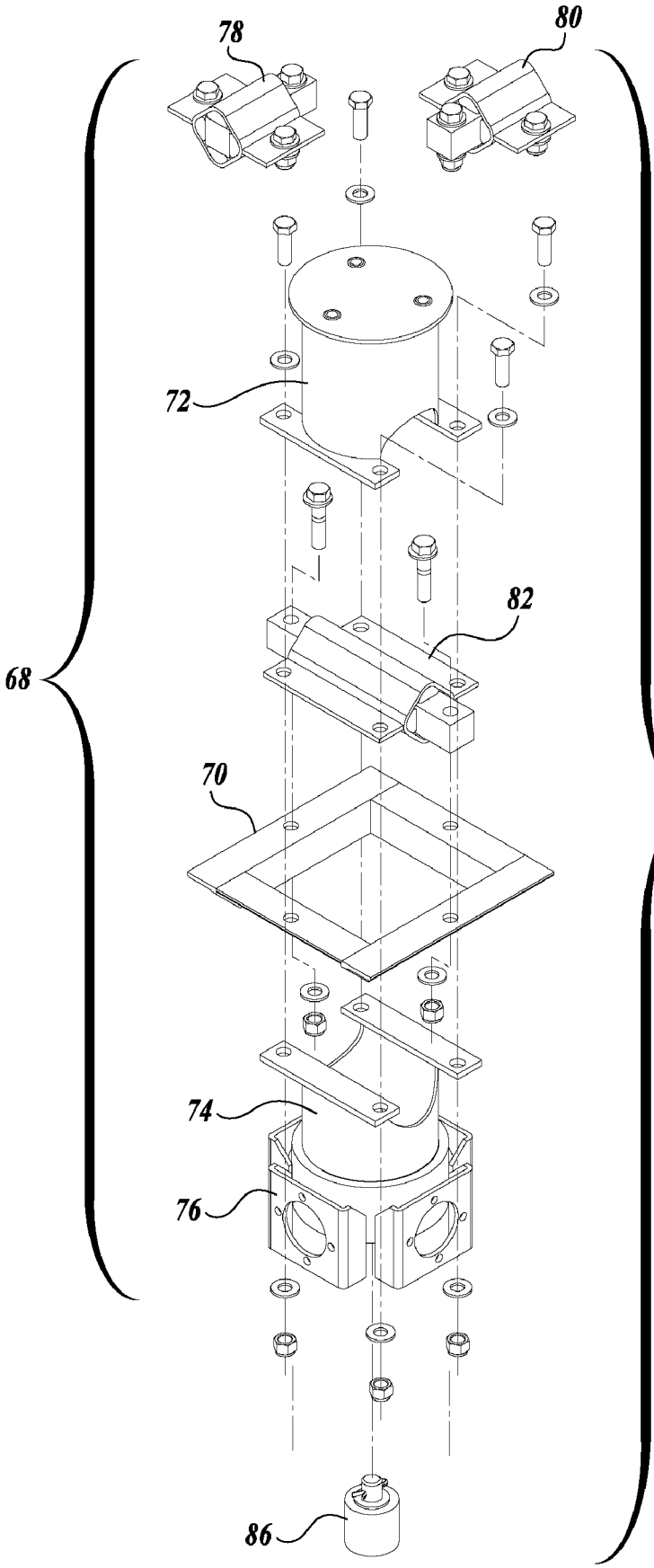
FIG. 5 is an exploded view of the column assembly of the center assembly of FIG. 4.

Now that the general movement of the play toy 20 has been described, the inner workings of the center mechanical assembly 60 will be described in greater detail. Returning to FIGS. 5 and 6, the column assembly 68 includes a swivel frame 70, a column (shown in the illustrated embodiment as first and second column portions 72 and 74), an arm connection portion 76 for connecting the arms 32 to the column assembly 68, and a biasing system for biasing the column assembly 68 in a plurality of directions.

In the illustrated embodiment, the biasing system includes a plurality of torsion bearings 78, 80, and 82. The torsion bearings are bars positioned in housings and surrounded by resilient material, such as a high strength polymer of rubber material. The torsion bearings are therefore designed to provide resistance and cushion to the rocking movement and/or substantially circular movement of the column assembly 68. It should be appreciated, however, that other biasing systems are also within the scope of the present disclosure, including but not limited to torsion bearings, springs, and pillow block bearings. In the illustrated embodiment the biasing system provide for movement in a plurality of dimensions, for example, substantially in x-, y-, and z-dimensions.

As mentioned above, in the illustrated embodiment, the column includes first and second column portions 72 and 74. The portions 72 and 74 are connected to one another by a plurality of fasteners. It should be appreciated, however, that the column may be configured as a single piece instead of a plurality of portions. The top of the first column portion 72 provide a surface upon which the center platform assembly 64 (see FIG. 4) may be attached. However, it should be appreciated that the play toy 20 may be configured without a center platform assembly 64, and only with satellite platforms 30 for users to play on.

Between the first and second column portions 72 and 74 is a bore for receiving the third torsion bearing 82. The third torsion bearing 82 connects to the swivel frame 70 by a plurality of fasteners. The first and second torsion bearings 78 and 80 connect the swivel frame 70 to the fixed frame 66 by a plurality of fasteners.

As seen in FIG. 11-14, the three torsion bearings 78, 80, and 82 provide a coupling between the movable column assembly 68 and the fixed frame 66. In that regard, the column assembly 68 is normally biased to the center position shown in FIG. 6, for example, at rest with no forces acting on the column assembly 68. However, as forces act on the column assembly 68, the column assembly 68 moves to a plurality of different positions, a few of which are shown in the top plan views of the play toy 20 in FIGS. 7-10 (with the resting position of the play toy 20 shown in phantom) and the perspective views of the play toy 20 in FIGS. 11-14.

Figure 11:
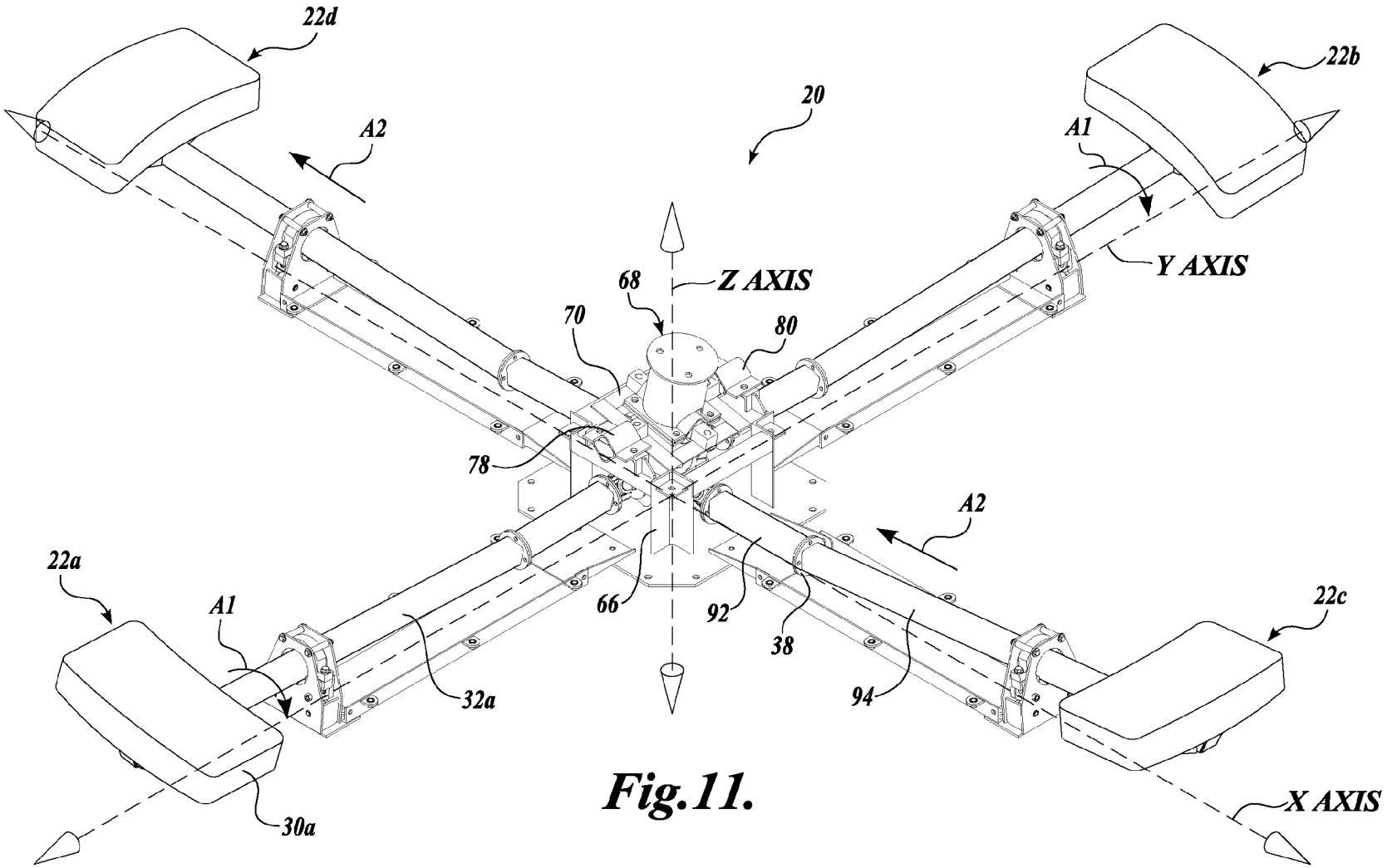
FIGS. 11-14 are perspective views of the play toy of FIG. 1 in a plurality of different positions.
Figure 12:
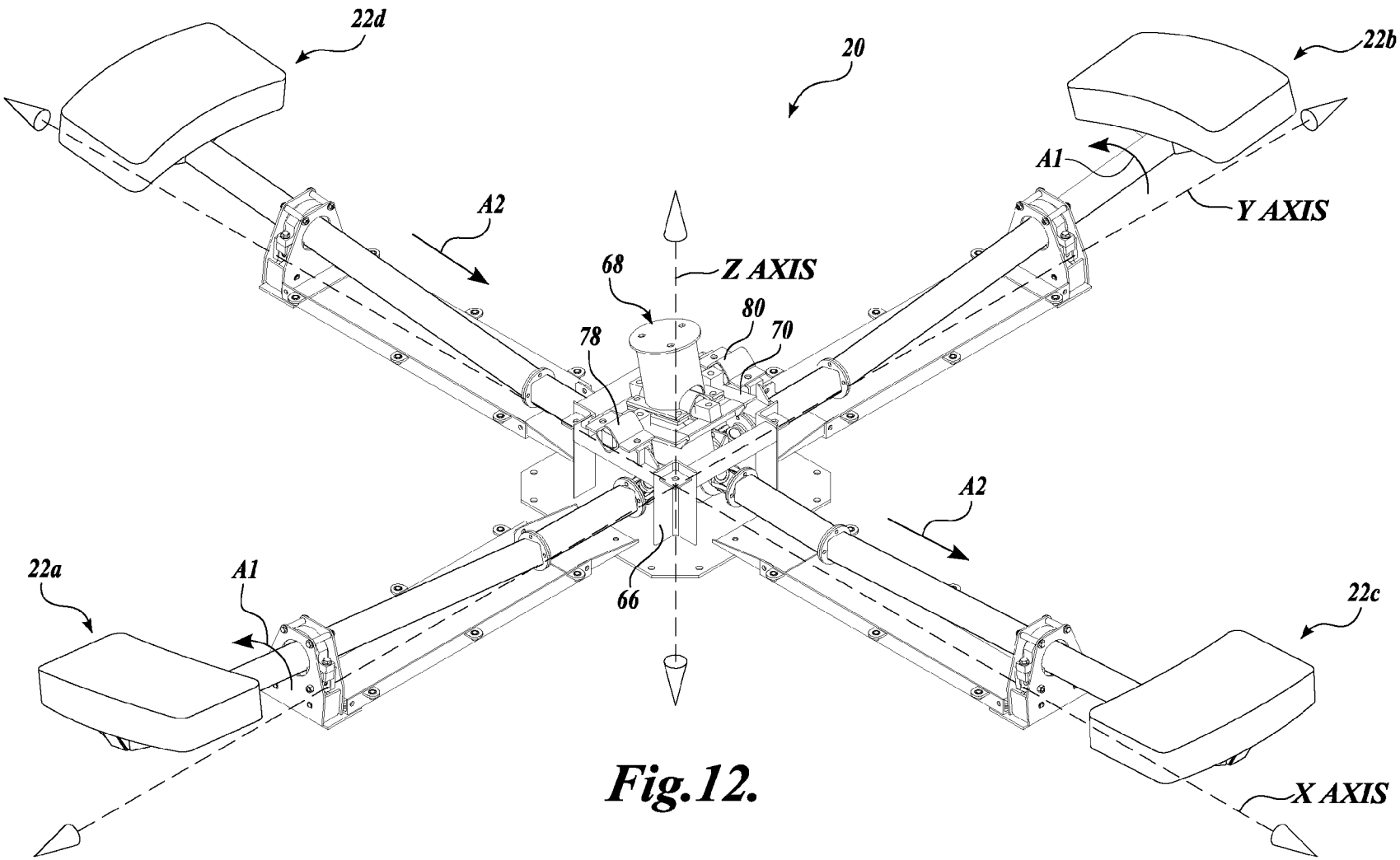

In the illustrated embodiment of FIG. 11, the first satellite assembly 22*a* is rocked to the right side (rotating about the y-axis, as indicated by arrow A1), as is the opposite satellite assembly 22*b*. The adjacent satellite assemblies 22*c* and 22*d* have moved, respectively, backward and forward (substantially linearly along an x-axis, as indicated by arrows A2). When the column assembly 68 rotates to the right about the y-axis, tension is put on the first and second torsion bearings 78 and 80 as the swivel frame 70 rotates relative to the fixed frame 66. FIG. 12 shows a rocking movement to the left, with opposite tension on the first and second torsion bearings 78 and 80.

Figure 13:
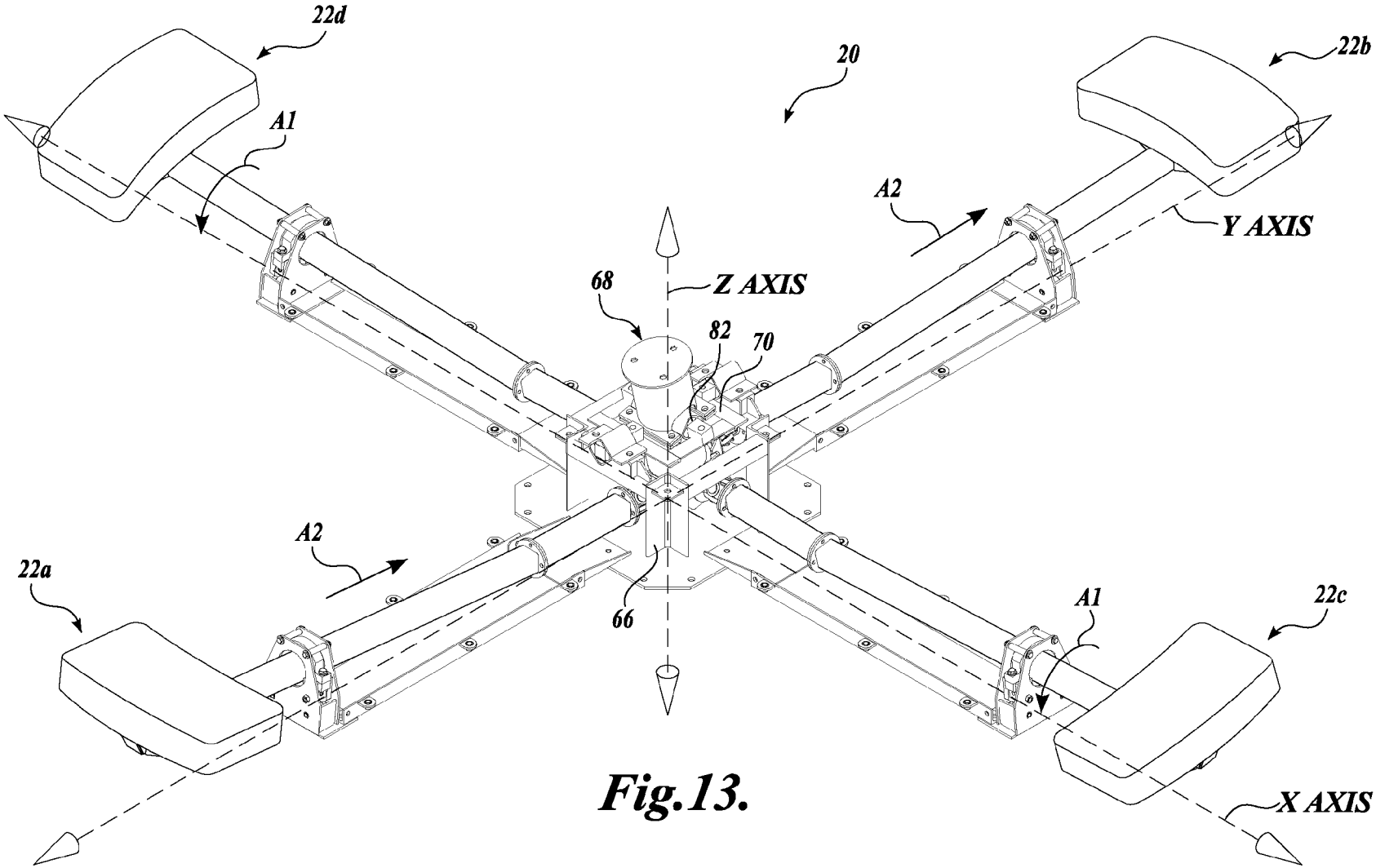
Figure 14:
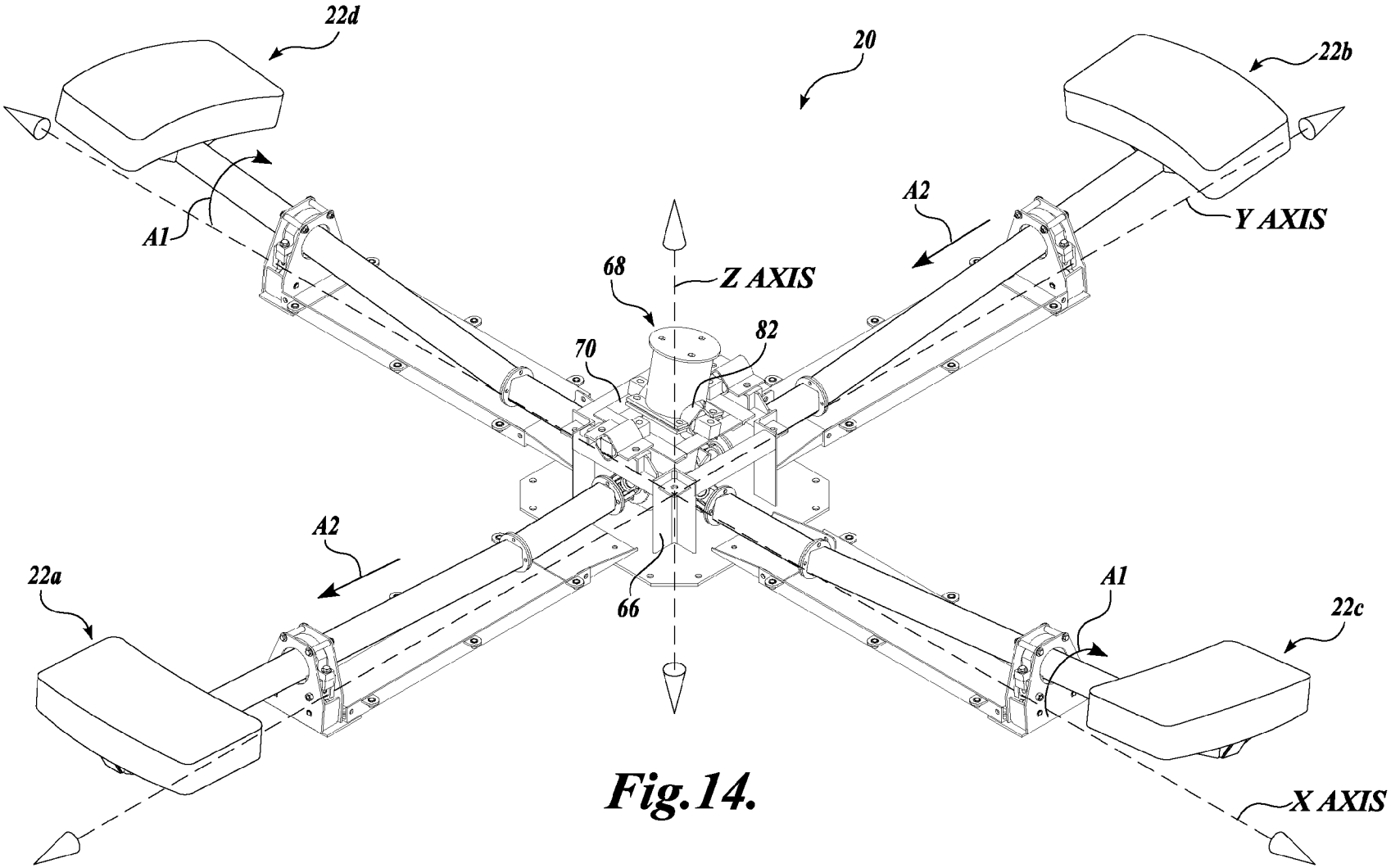

In the illustrated embodiment of FIG. 13, the adjacent satellite assembly 22*c* is rocked to the left side (rotating substantially about an x-axis, as indicated by arrow A1), as is the opposite satellite assembly 22*d*. The other satellite assemblies 22*a* and 22*b* have moved, respectively, backward and forward (substantially linearly along the y-axis, as indicated by arrows A2). When the column assembly 68 rotates to the left substantially about an x-axis, tension is put on the third torsion bearings 82 as the column assembly 68 rotates relative to the fixed frame 66. FIG. 14 shows a rocking movement to the right, with opposite tension on the third torsion bearings 82.

Returning to FIG. 5, the center column assembly 68 further includes a center stop 86 for limiting the movement of the column assembly 68 relative to the fixed frame 66. In that regard, the column second portion 74 has a hollow interior that receives the center stop 86, which is fixed to the base 132 of the fixed frame 66. As the column assembly 68 moves from side-to-side or in a circular movement, the center stop 86 prevents the column assembly 68 from tipping too far from center to effectively limit the range of motion of the play toy 20. It should be appreciated that the limit stop 86 may be made from or may include a cover made from a resilient matter, for example, a rubber or a polymer material, to provide a cushioning limit stop 86 for the center column assembly 68.

Returning to FIG. 4, the center platform assembly 64 generally includes a platform 100 for a user to stand, sit, or otherwise ride on the center assembly 24. The center platform assembly 60 further includes a support frame 102 for supporting the center platform 100 and attaching to the column assembly 68. As seen in the illustrated embodiment, the support frame 102 includes a center plate 104 and a plurality of spokes 106 that couple to the upper shield 124, described below.

The center plate 104 of the support frame 102 mates with a support plate 108 to couple the center plate 104 to the column assembly 68. Although the center plate 104 and support plate 108 are shown as hexagonal plates in the illustrated embodiment, it should be appreciated that any shape of plate is within the scope of the present disclosure, including but not limited to circular shape, as well as other polygonal shapes.

The platform assembly 100 further includes an access plate 112 for providing access to the fasteners connecting the support frame 102 to the column assembly 68, for example, for disassembly or repair. In addition, the center platform 100 is couples to the upper shield 124 by a plurality of fasteners (not shown) and fastener thru-holes located around the periphery of the platform 100 and upper shield 124. The platform assembly 100 further includes a rubber bumper 110 to cover the fasteners for user protection.

The center cover assembly 62 generally includes a lower shield 120, a middle shield 122, and an upper shield 124 for protecting the users from the mechanical assembly of the play toy 20 and eliminating any pinch points. As seem in the illustrated embodiment, the upper shield 124 includes a plurality of spoke receiving points 126 for attachment to the support frame 102.

Figure 15:
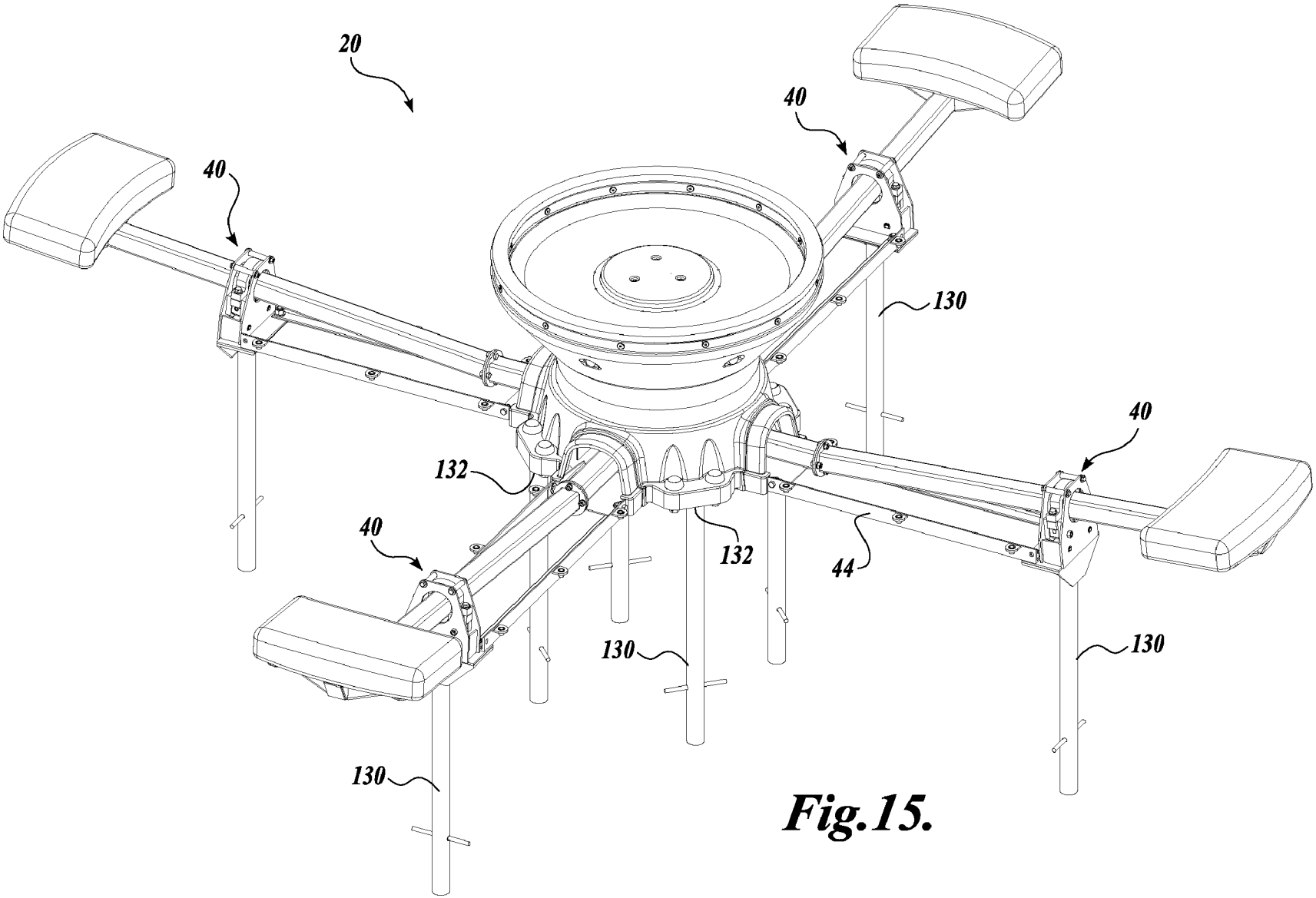
FIG. 15 is a perspective view of the play toy of FIG. 1 including a grounding system.

Referring to FIG. 15, a grounding system for the play toy 20 designed in accordance with embodiments of the present disclosure is shown. In that regard, the play toy 20 may include a plurality of grounding rods 130 that can be embedded underground and connected to various components of the play toy 20 to keep the play toy 20 from moving when it is subjected to various forces. Specifically, the grounding rods may be secured to the satellite bearing assemblies 40 and at various positions on the base 132 attached to the fixed frame 66 of the center assembly 24 (see also FIG. 6). It should be appreciated, however, that other grounding systems are also within the scope of the present disclosure, including but not limited to surface mounting, for example, bolting the play toy 20 to a concrete slab.

While illustrative embodiments have been illustrated and described, it will be appreciated that various changes can be made therein without departing from the spirit and scope of the disclosure.

The embodiments of the disclosure in which an exclusive property or privilege is claimed are defined as follows:

1. A collaborative play toy, comprising:
(a) a plurality of satellite assemblies capable of a first movement and a second movement; and
(b) a center assembly coupled to the plurality of satellite assemblies, wherein the center assembly is configured to move in response to the first movement of a first satellite assembly and to create a second movement in a second satellite assembly, wherein the center assembly includes at least one biasing member.

2. The play toy of claim 1, wherein the center assembly is movably coupled to the plurality of satellite assemblies by a movable coupling.

3. The play toy of claim 2, wherein the movable coupling is selected from the group consisting of a universal joint, a flexible joint, a living hinge, and a swivel block.

4. The play toy of claim 1, wherein the center assembly is capable of movement selected from the group consisting of rocking movement, substantially circular movement, and combinations thereof.

5. The play toy of claim 1, wherein the plurality of satellite assemblies are capable of movement selected from the group consisting of rocking movement, forward and backward movement, and combinations thereof.

6. The play toy of claim 1, wherein the first movement is a rocking movement.

7. The play toy of claim 1, wherein the second movement is a substantially linear movement.

8. The play toy of claim 1, wherein a first satellite assembly is capable of rocking movement, and wherein the center assembly moves in response to the rocking movement to create a forward and backward movement in the second satellite assembly.

9. The play toy of claim 1, wherein the at least one biasing member is selected from the group consisting of torsion bearings, springs, and pillow block bearings.

10. The play toy of claim 1, wherein each of the plurality of satellite assemblies include at least a first bearing for rotational movement and a second bearing for substantially linear movement.

11. The play toy of claim 1, wherein the center assembly is capable of movement selected from the group consisting of rocking movement, circular movement, and combinations thereof.

12. The play toy of claim 1, wherein the center assembly includes at least one biasing member.

13. The play toy of claim 1, wherein the at least one biasing member is selected from the group consisting of torsion bearings, springs, and pillow block bearings.

14. The play toy of claim 1, wherein each of the plurality of satellite assemblies include a first bearing for rotational movement and a second bearing for substantially linear movement.

15. A collaborative play toy, comprising:

(a) a plurality of satellite assemblies capable of movement; and (b) a center assembly coupled to the plurality of satellite assemblies for linking movement, wherein a first satellite assembly is capable of rocking movement, causing the center assembly moves in response to the rocking movement to create a substantially linear movement in the second satellite assembly.

16. A collaborative play toy, comprising:

(a) a plurality of satellite assemblies capable of a first movement and a second movement; and (b) a center assembly movably coupled to the plurality of satellite assemblies by a universal joint, wherein the center assembly includes a biasing system configured to move in response to the first movement of a first satellite assembly and to create a second movement in a second satellite assembly.

17. The play toy of claim 16, wherein the biasing system allows movement in a plurality of directions.

18. The play toy of claim 16, wherein the biasing system is selected from the group consisting of torsion bearings, springs, and pillow block bearings.

* * * * *